United States Patent [19]

Gustafsson et al.

[11] Patent Number: 4,896,524

[45] Date of Patent: Jan. 30, 1990

[54] DEVICE FOR THE EJECTION OF PRESSINGS OUT OF A PRESS TOOL

[75] Inventors: Jan A. K. Gustafsson; Per-Göran Larsson, both of Tranås, Sweden

[73] Assignee: Stromsholmens Mekaniska Verkstad AB, Tranas, Sweden

[21] Appl. No.: 252,275

[22] PCT Filed: Feb. 3, 1987

[86] PCT No.: PCT/SE87/00048

§ 371 Date: Sep. 28, 1988

§ 102(e) Date: Sep. 28, 1988

[87] PCT Pub. No.: WO87/06165

PCT Pub. Date: Oct. 22, 1987

[51] Int. Cl.[4] ..... B21D 45/04

[52] U.S. Cl. ..... 72/427; 267/119

[58] Field of Search ..... 72/427; 267/119

[56] References Cited

U.S. PATENT DOCUMENTS 1,571,673 2/1926 Jayne .
2,280,849 4/1942 Pocock ..... 72/427
3,157,111 11/1964 Anderson .
3,295,351 1/1967 Jacobs .
3,805,577 4/1974 Bergemann ..... 72/427
3,911,718 10/1975 Requarth ..... 72/427
3,914,978 10/1975 Sekanina et al. ..... 267/119

FOREIGN PATENT DOCUMENTS 2845092 4/1980 Fed. Rep. of Germany .

*Primary Examiner*—Lowell A. Larson
*Attorney, Agent, or Firm*—Albert L. Jeffers; Anthony Niewyk

[57] ABSTRACT

Arrangement for the ejection of a pressed component from a press tool. The arrangement consists of a number of ejection pins distributed over the press surface tool. Each of the ejection pins is so arranged as to lie during the pressing operation with its tip no higher than on a level with the aforementioned press surface, and, in conjunction with the opening of the tool after a pressing operation has been completed, as to eject the component from the tool with its tip. A characteristic feature of the invention is that each ejection pin is operatively connected via a pistion rod to a hydraulic piston. The piston is capable of axial displacement in a hydraulic cylinder, which is filled with an incompressible fluid in space between the piston and an end wall of the cylinder. The space communicates via a duct with a drive unit for the ejection pin.

6 Claims, 2 Drawing Sheets

Figures 1A, 1B, 1C:
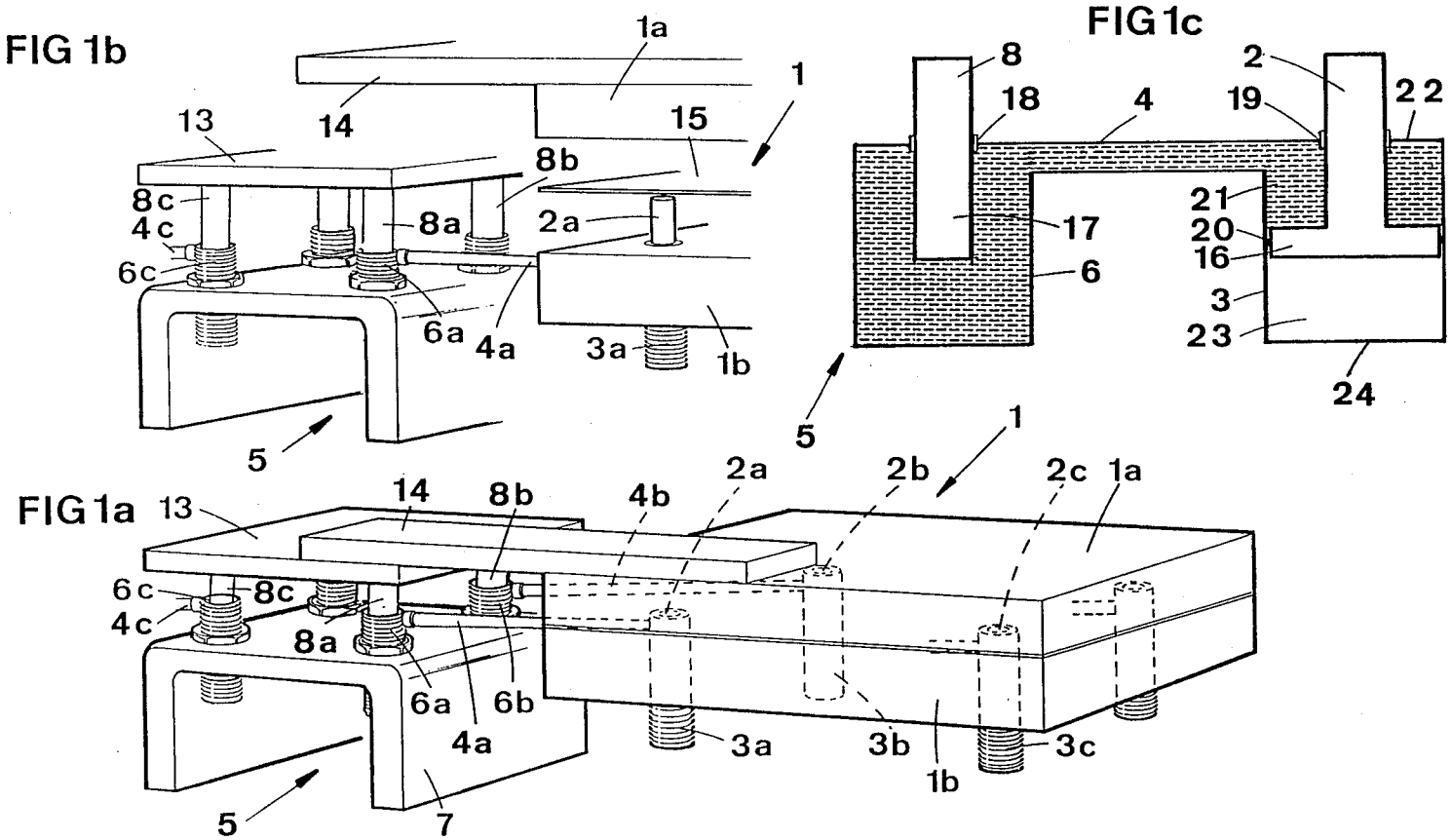

1
1a
1b
2
2a
2b
2c
3
3a
3b
3c
4
4a
4b
4c
5
6
6a
6b
6c
7
8
8a
8b
8c
13
14
15
16
17
18
19
20
21
22
23
24

DEVICE FOR THE EJECTION OF PRESSINGS OUT OF A PRESS TOOL

The present invention relates to an arrangement for the ejection of a pressed component from a press tool consisting of a number of ejection pins distributed over the press surface of the press tool, each of said pins being so arranged as to lie during the pressing operation with its tip no higher than on a level with the aforementioned press surface, and, in conjunction with the opening of the tool after a pressing operation has been completed, as to eject the component from the tool with its tip.

A critical factor which governs the efficiency with which a press can be used is the speed at which a pressed component can be removed from the press tool and new material can be introduced. The importance of the aforementioned operations being performed rapidly and with high precision is further accentuated in multistage presses of the kind which are found, for example, in the automobile industry, in which a fault in one of the pressing stages will prevent the execution of all the other stages.

A large number of solutions have already been proposed to the problem of rapidly achieving the ejection of the pressed component. In order to be able to guarantee that the surface finish of the components will not be damaged by the ejection pins at the plate thicknesses which are now common, it is necessary for the force exerted by each of these to be relatively small, that is to say a large number of ejection pins is required per unit of surface area. In the case of previously disclosed ejection devices, at least two hydraulic lines are required for each ejection pin, and since the design of press tools has now become extremely complex, it has proved necessary, partly for reasons of space, to accept a reduction in the number of ejection pins.

The object of the present invention is to make available an ejection arrangement of the kind referred to by way of introduction which will permit the use of a sufficiently large number of ejection pins per unit of surface area of the press surface of the tool for the surface finish of the pressed component not to suffer damage on being ejected, but without jeopardizing the function of the press tool by the presence of a large number of hydraulic lines for the ejection pins. This is permitted in accordance with the invention in that each ejection pin is operatively connected via a piston rod to a hydraulic piston which is capable of axial displacement in a hydraulic cylinder filled with an incompressible fluid in a space between the piston and an end wall of the cylinder, which space communicates via a duct with a drive unit for the ejection pins, which unit consists of a number of mechanically inter-connected hydraulic cylinders with associated pistons which corresponds to the number of ejection pins, the piston rods of which are so arranged as to be carried in a synchronous fashion by the moving half of the press tool, in conjunction with which the pistons are influenced by a spring device acting in the direction of ejection.

In accordance with a specific characteristic feature of the invention the cylinders are adjustable relative to a fixed reference for the purpose of achieving synchronism between the ejection pins.

A preferred embodiment of the invention is characterized in accordance with a second specific characteristic feature of the invention in that the hydraulic cylinder which interacts with the ejection pin is sealed against the corresponding piston rod, in that the space of the ejection cylinder filled with incompressible fluid is defined not only by the piston and the cylinder wall, but also by the end wall in which the seal against the piston rod is arranged, in that the duct is connected in an area close to the aforementioned seal, in that the pistons of the drive unit are of the plunger type, and in that the aforementioned spring is a gas spring which consists of a compressible fluid enclosed within a space which is defined by the piston of the ejection pin, the walls and the end wall of the hydraulic which interacts with the ejection pin at the opposite end to the seal.

In accordance with a further characteristic feature of the invention an alternative embodiment of the invention is characterized in that the space of the ejection cylinder filled with an incompressible medium is defined not only by the piston and the cylinder wall, but also by the uninterrupted end wall of the ejection cylinder, in that each duct is connected to the cylinders of the drive unit for each ejection pin at or in the vicinity of the uninterrupted end wall of each cylinder, in that the piston rods of the drive unit are attached at their outer ends by means of a yoke, and in that the aforementioned spring, preferably of the gas type, is fixed between the yoke and the mechanically inter-connected cylinders in the drive unit and is so arranged, when the tool is opened, as to push the pistons into each cylinder in such a way that the pressed component is ejected by the pins, and as to be overcome by the pressing operation so that the ejection pins are brought to the same level as the press surface.

The invention is described in more detail below with reference to the accompanying drawing, in which FIGS. 1*a* and 1*b* illustrate schematically in perspective view a preferred embodiment of an ejection arrangement in accordance with the invention for a pressed component, interacting with a press tool shown in its closed and open position respectively.

FIG. 1*c* illustrates schematically the construction of the ejection device shown in FIGS. 1*a* and 1*b*.

Figures 2A, 2B, 2C:
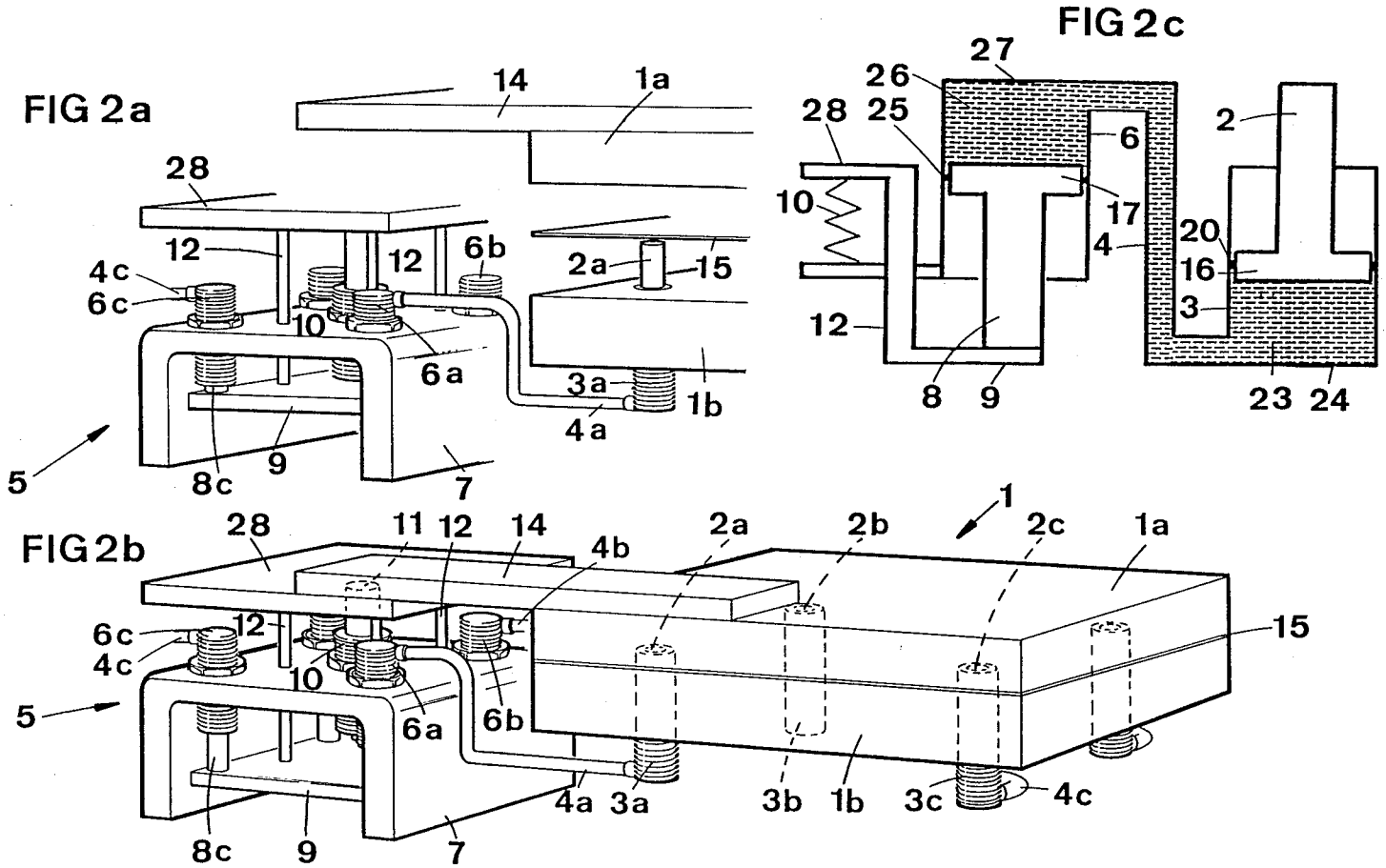

FIGS. 2*a*, 2*b* and 2*c* show in a manner similar to FIGS. 1*a*, 1*b* and 1*c* an alternative embodiment of the invention.

The designation 1 is used generally in the drawing in respect of a press tool with an upper, moving tool half 1*a* and a lower, fixed tool half 1*b*. The press tool is executed in a conventional fashion with raised and recessed parts, which are not shown in the drawing, in order to produce a component with the desired form.

The ejection arrangement consists of a number of ejection pins 2*a*, 2*b*, 2*c*, . . . distributed in the lower tool half 1*b* of the press surface of the press tool 1, each pin constituting the outer part of a piston rod or being operatively connected to a hydraulic piston 16*a*, 16*b*, 16*c*, . . . , which piston is capable of axial displacement in an associated cylinder 3*a*, 3*b*, 3*c*, . . . . Each hydraulic cylinder communicates via a duct 4*a*, 4*b*, 4*c*, . . . with a drive unit for the ejection pins 2*a*, 2*b*, 2*c*, . . . . This consists of a number of hydraulic cylinders 6*a*, 6*b*, 6*c*, . . . corresponding to the number of ejection pins, which cylinders are attached to a frame 7 and are thus mechanically inter-connected. The cylinders 6*a*, 6*b*, 6*c*, . . . communicate via ducts 4*a*, 4*b*, 4*c*, . . . with the respective cylinders 3*a*, 3*b*, 3*c*, . . . .

Each cylinder 6*a*, 6*b*, 6*c*, . . . has its own piston 17*a*, 17*b*, 17*c*, . . . and piston rod 8*a*, 8*b*, 8*c*, . . . . Between these piston rods and the upper, moving half 1*b* of the tool 1 is an operative connection such that the piston rods 8*a*, 8*b*, 8*c*, . . . are influenced by the opening and closing movements of the half 1*b* of the tool, in conjunction with which the movements of the piston rods 8*a*, 8*b*, 8*c*, . . . are transmitted by means of an incompressible fluid to the ejection pins 2*a*, 2*b*, 2*c*, . . . so that these move in an ejection direction when the tool 1 is opened. The pistons 16*a*, 16*b*, 16*c*, . . . and 17*a*, 17*b*, 17*c*, . . . are also influenced in accordance with the invention by a spring force acting in the direction of ejection. The transmission of movement and the spring force are executed differently in the case of the preferred embodiment of the invention in accordance with FIGS. 1*a*, 1*b*, 1*c*, . . . , which is described first, than in the case of the alternative embodiment in accordance with FIGS. 2*a*, 2*b*, 2*c*, . . . .

In FIG. 1*c*, which may be taken as representing the constituent hydraulic components of the arrangement in accordance with FIGS. 1*a*, 1*b*, the piston 17 is of the plunger type, for which reason the connection of the duct 4 can be positioned in any desired fashion, and the piston rod 8 is sealed against the cylinder 6 by means of a seal 18. The piston rod and its associated piston 16 for the ejection pin 2 are sealed against the cylinder 3 by means of seals 19 and 20. The cylinder 6, the duct 4, and a space 21 in the cylinder 3, which is defined not only by the piston 16 and the cylinder wall, but also by the end wall 22 in which the seal 19 for the piston rod is arranged, are filled with an incompressible fluid, which has been marked in FIG. 1*c* by a pattern of broken lines. The duct 4 is connected to the cylinder 3 in an area in the vicinity of the seal 19 so that the flow of fluid through it will not be disturbed by movements of the piston 16. The aforementioned spring force acting in the direction of ejection is generated by a compressible fluid enclosed in a space 23 which is defined by the piston 16, the walls of the cylinder 3 and the end wall 24 opposite the end wall 22. The aforementioned operative connection between the tool half 1*a* and the piston rods consists of a sheet 13, to which the ends of the aforementioned piston rods are attached, and an elongated device 14 projecting from the aforementioned tool half, which device is so arranged as to push the sheet 13 downwards during the pressing operation. In this way the piston rods with their plunger pistons 17 are pushed into their respective cylinder and force fluid via the respective duct 4 into the respective space 21. During compression of the compressible fluid in the space 23, the piston 16 is pushed inwards into the cylinder 3 so that the ejection pin 2 is caused to lie on a level with the press surface of the press tool 1.

When the tool 1 is opened after a pressing operation has been completed, the upper half 1*a* of the tool will move upwards, in conjunction with which the pushing down of the sheet 13 via the elongated device 14 will cease. Under the effect of the spring force on the compressed fluid enclosed in the space 23, the pistons 16 are forced upwards and the ejection pin 2 ejects the pressed component 15. At the same time fluid is forced out of the space 21 via the duct 4 to the cylinder 6. After introducing a new sheet blank for pressing in the tool 1, the procedure described above is repeated.

In FIG. 2*c*, which may be taken as representing the constituent hydraulic components of the arrangement in accordance with FIGS. 2*a*, 2*b*, the piston 17 is sealed against the wall of the cylinder 6 by means of a seal 25, and the piston 16 has the seal 20, as before. There are no seals, however, between the piston rod 8 and the cylinder 6 and between the ejection pin 2 and the cylinder 3. The spaces 23 and 26 between the pistons 16 and 17 and the corresponding uninterrupted end walls 24 and 27 communicate via the duct 4 and are filled with an incompressible fluid, which, as before, has been marked as a pattern of broken lines. The connections of the duct to each cylinder 3, 6 are situated close to the uninterrupted end wall 24, 27 so as not to obstruct the fluid flow through the duct 4.

With reference to FIGS. 2*a* and 2*b* the piston rods 8*a*, 8*b*, 8*c*, . . . are connected by means of a yoke 9 which is operatively connected to a compressive gas spring 10 acting between the yoke and the frame 7. The operative connection between the yoke 9 and the piston rod 11 of the gas spring 10 consists of rods 12 which are mounted in the frame 7 in such a way that they are free to slide, said rods connecting the yoke 9 to a sheet 28 against which the piston 10 is in contact.

The elongated device 14 which projects from the upper tool half 1*a* is so arranged in a similar fashion to the embodiment in accordance with FIG. 1 as to push the sheet 28 downwards during the pressing operation, against the effect of the gas spring 10, see FIG. 2*a*, and as to leave the sheet 28 unactuated when the tool 1 is open, see FIG. 2b.

The ejection arrangement in accordance with FIGS. 2*a*, 2*b* and 2*c* operates in the following way: In FIG. 2*a*, which shows the press tool 1 during a pressing operation, the sheet 28 is pushed down as far as a bottom end position by the elongated device 14 against the effect of the gas spring 10. Because the sheet 28 and the yoke 9 are connected to one another via the rods 12, the yoke 9 will accordingly also be caused to be pushed down as far as its bottom end position, and in so doing to pull down the piston rods 8*a*, 8*b*, 8*c*, . . . . The negative pressure which is thus produced inside the cylinders 6*a*, 6*b*, 6*c* . . . , in this way passes via the ducts 4*a*, 4*b*, 4*c*, . . . to the corresponding cylinders 3*a*, 3*b*, 3*c*, . . . , which means that the ejection pins 2*a*, 2*b*, 2*c*, . . . are drawn into the respective cylinder so that the tips of the pins lie on the same plane as the press surface.

On completion of a pressing operation the upper half 1*a* of the tool moves upward together with the elongated device 14, in conjunction with which the action of the latter on the sheet 28 gradually ceases. Under the effect of the gas spring 10 the sheet 28 is accordingly pushed upwards as far as its upper end position, as shown in FIG. 2*b*. The yoke 9 accordingly also moves upwards and forces the piston rods 8*a*, 8*b*, 8*c*, . . . into their respective cylinders 6*a*, 6*b*, 6*c*, . . . . The positive pressure which is thus produced inside the cylinders passes via the ducts 4*a*, 4*b*, 4*c*, . . . to the corresponding cylinders 3*a*, 3*b*, 3*c*, . . . , which means that the ejection pins 2*a*, 2*b*, 2*c*, . . . are pushed out, in conjunction with which a newly pressed component 15, see FIG. 2*b*, is ejected from the lower part 1*b* of the tool. It will be appreciated that, by adjusting the relative position of a hydraulic cylinder, the starting position of the appropriate ejection pins can be varied.

In the embodiment of the invention described above all the hydraulic cylinders are identical, which is of advantage with regard to the availability of spare parts. This has been made possible by the fact that the cylinders 6*a*, 6*b*, 6*c*, . . . and the gas spring 10 act in opposite directions and interact via the operative connection, which consists of the yoke 9, the rods 12 and the sheet 28. As an alternative embodiment within the scope of the idea of invention the cylinders 6*a*, 6*b*, 6*c*, . . . and the gas spring 10 can be caused to act in the same direction, although the piston rods 8*a*, 8*b*, 8*c*, . . . in this case are sealed against their respective cylinder, as in the embodiment in accordance with FIGS. 1*a*, 1*b* and 1*c*, and the connection of the hoses 4*a*, 4*b*, 4*c*, . . . is arranged close to the aforementioned seals.

Not only the cylinders 3*a*, 3*b*, 3*c*, . . . , but also the cylinders 6*a*, 6*b*, 6*c*, . . . and the gas spring 10 are preferably provided with external threads and are screwed into the half 1*b* of the tool and into the frame 7 and are secured with a nut. The possibility is afforded in this way of adjusting the aforementioned units relative to one another for the purpose of achieving full synchronism between the ejection pins 2*a*, 2*b*, 2*c* . . . .

We claim:

1. An assembly for the ejection of a pressed component from a press tool in a predetermined direction after completion of a pressing operation, said press tool including a moving section and a second section, said moving section and second section adapted to separate at a press surface, said assembly comprising a plurality of ejection pins located within said second section and distributed over said press surface each of said ejection pins having an end thereof located no higher than said press surface during a pressing operation of said press tool, each said ejection pin end adapted to eject a component from said press tool after completion of a pressing operation, characterized in that each ejection pin is operatively connected with an ejection piston rod to a hydraulic ejection piston, said hydraulic ejection piston axially movably disposed in a hydraulic ejection cylinder having an ejection cylinder wall, said ejection cylinder including an ejection space defined by said ejection piston and said ejection cylinder wall, said ejection space filled with an incompressible fluid, said ejection space being in open communication with a duct and a drive means for driving said ejection pins, said drive means comprising a plurality of mechanically inter-connected hydraulic drive cylinders including associated drive pistons and drive piston rods corresponding to said plurality of ejection pins, said drive piston rods adapted to move in synchronism with the moving section of the press tool, and a resilient means for urging said drive pistons and ejection pistons into said predetermined direction.

2. The assembly according to claim 1, including means for adjusting the positions of said ejection and drive cylinders relative to a fixed reference whereby the movement of said ejection pins may be sychronized.

3. The assembly according to claim 1, characterized in that each said ejection space is further defined by a first end wall of said ejection cylinder, a seal disposed in each said ejection space and sealingly engaged with a said ejection piston rod, a said duct connected to each said hydraulic ejection cylinder in an area close to said seal, said drive pistons comprising plunger type pistons, and said resilient means comprising a gas spring which includes a compressible fluid confined within a spring space, said spring space defined by said ejection piston, said ejection cylinder wall, and a second end wall of said ejection cylinder.

4. The assembly according to claim 1, characterized in that said ejection space is further defined by an end wall of said ejection cylinder, each said duct being connected to a respective drive cylinder of said drive means at a location near a said respective end wall of each respective ejection cylinder, the outer ends of said piston drive rods attached to a yoke, said resilient means connected between said yoke and said drive cylinders whereby, when said press tool is opened, said drive pistons are pushed into each said drive cylinder so that a pressed component is ejected by said ejection pins, and so that, during a pressing operation, said ejection pins are moved toward said press surface.

5. The assembly according to claim 1 wherein said resilient means comprises a cylinder filled with a compressible fluid.

6. The assembly according to claim 1 wherein said resilient means comprises a spring.

* * * * *